United States Patent [19]

Waiser

[11] 4,291,610

[45] Sep. 29, 1981

[54] SILENCER FOR FIREARMS

[76] Inventor: Shimon Waiser, P.O. Box 360 Midwood Station, Brooklyn, N.Y. 11230

[21] Appl. No.: 24,474

[22] Filed: Apr. 19, 1979

Related U.S. Application Data

[63] Continuation-in-part of Ser. No. 857,464, Dec. 5, 1977, abandoned.

[51] Int. Cl.[3] ..... F41L 21/18

[52] U.S. Cl. ..... 89/14 D

[58] Field of Search ..... 89/14 D; 181/223, 249, 181/250, 251

[56] References Cited

U.S. PATENT DOCUMENTS

| | | | |
|---|---|---|---|
| 1,173,687 | 2/1916 | Thompson | 181/223 |
| 2,101,848 | 12/1937 | Green | 181/223 |
| 3,492,912 | 2/1970 | Ashbrook | 181/223 |
| 3,748,956 | 7/1973 | Hubner | 89/14 D |
| 3,786,895 | 1/1974 | Perrine | 89/14 D |

FOREIGN PATENT DOCUMENTS

| | | | |
|---|---|---|---|
| 101841 | 1/1924 | Switzerland | 89/14 D |

*Primary Examiner*—Stephen C. Bentley

[57] ABSTRACT

A firearm silencer comprising a tubular casing with a few partitions which divide the interior of the said silencer to a number of chambers with a passage therethrough for the projectile. The second chamber from the muzzle end of the silencer has a type of construction, that separates discharged gases into plurality of streams and then forces them to collide among themselves.

7 Claims, 19 Drawing Figures

SILENCER FOR FIREARMS

This application is a continuation in part of Ser. No. 857,464 filed date Dec. 5, 1977, now abandoned.

This invention relates to a small arms silencer. The principal objective of this invention is the effective reduction of noise associated with the muzzle blast of a firearm. The second aim of the invention is to reduce the size and weight of a silencer.

This invention comprises a tubular casing which can be detachably mounted on the muzzle of the firearm or it can also be a basic component of the weapon. Such a silencer has several chambers within it, with the second chamber from the muzzle end of the silencer having a type of construction, which separates discharged gases into a lot of streams and then forces them to collide among themselves.

There are many constructions of silencers for small weapons. One form of silencers includes a lot of conical partitions which divide the interior of the silencer sleeve into many individual chambers. However, the performance of this silencer is not satisfactory. Another construction of silencer comprises a tubular casing which is mounted on the muzzle of the firearm. This silencer has a plurality of chambers therein, with the second chamber from the muzzle end of the silencer having a tube for the passage of the projectile through it and tapered openings in the partition between the first and second chambers to admit discharged gases into the second chamber. The third chamber from the muzzle end of this silencer consists of a number of conical partitions to divide this chamber into smaller individual chambers. Here again the performance of this silencer is not satisfactory.

Therefore, the main purpose of the present invention is to present an absolutely new and effective form of a silencer which can be detachably mounted on the muzzle of a weapon or can be a basic component of a weapon. The purpose of the present invention is achieved by the silencer disclosed herein. This silencer consists of a cylindrical casing and several partitions therein. These partitions and the end wall of the casing have aligned apertures with them for the passage of the bullet through the silencer. The detail forming the second chamber from the muzzle end of the silencer has a form which separates the discharged gases into a main stream (the axis of this stream is simultaneously the axis of the silencer, and this stream passes through the apertures for the projectile) and into many auxiliary streams. The axes of these auxiliary streams cross with the axis of the main stream, resulting in a dispersion of the discharged gases and a decrease of their energy. In the third chamber from the muzzle end of the silencer, several conical partitions are envisaged to divide this chamber into smaller separate chambers. The apices of these conical partitions are directed toward the muzzle end of the silencer. These conical partitions have openings for the passage of the bullet through them. The conical form of these partitions also forces the sound waves to disperse.

Here 7 different variations of silencer which can be built with this invention are presented.

When the firearm to which the silencer is fitted is discharged, the first chamber within the casing is filled by the discharged gases which have pushed the bullet from the muzzle of the weapon. After this the discharged gases burst into the second chamber. There are a few ways in which these gases can burst into the second chamber. The first way is through the opening for the passage of the projectile in the partition between the first and second chambers. The second way is through many holes which are in the same partition between the first and the second chambers (in the second variation; see FIG. 4) or in the dividing partition separating the second chamber into two distinct parts (in the first, third, fourth, fifth, sixth and seventh variations; see FIG. 1, FIG. 6, FIG. 9, FIG. 12, FIG. 14 and FIG. 17 respectively). Thus, all discharged gases are separated into a main stream (which goes through openings for passage of the projectile) and a lot of auxiliary streams. The axes of these auxiliary streams cross the axis of the main stream. Therefore, the auxiliary streams strike the main stream and disperse it. The movement and energy of the discharged gases are greatly dissipated.

If we have silencer of the first, the second, the sixth or the seventh variation, (see FIG. 1, FIG. 4, FIG. 14 and FIG. 17 respectively) then the discharged gases burst from the second chamber to the third chamber. Here again there are a few ways through which these gases can burst into the third chamber. The first way is through the opening for the passage of the projectile in the partition between the second and the third chambers. The second way is through a lot of holes which are in the same partition between the second and the third chambers. Thus, all discharged gases being in the second chamber are separated again into the main stream (which goes through openings for passage of the projectile) and many auxiliary streams. Again the same action takes place which took place when the discharged gases passed from the first chamber to the second chamber. And again the discharged gases lose a portion of their movement and energy.

If we have the third, the fourth or the fifth variation of the silencer, then one part of the discharged gases burst from the second chamber into the third chamber through the opening for the passage of the projectile in the partition between the second and the third chambers, and the second and larger part of the discharged gases bursts into the fourth chamber through the opening in the partition between the second and the fourth chambers. The discharged gases can flow back from the fourth chamber into the second chamber only after a large portion of the movement and energy of the discharged gases has been dissipated. These gases with much of their energy being absorbed, can then flow from the second chamber to the third chamber through the opening for the passage of the projectile in the partition between the second and the third chambers.

Thus, in the second chamber an absolutely new principle is used, based on the separation of the discharged gases into a few streams. The main stream seeks to exit through the opening for the passage of the projectile, and the auxiliary streams (which consist of a greater amount of the discharged gases than does the main stream) hit the sides of the main stream of the discharged gases. This action very effectively forces the discharged gases to lose their energy and their movement.

Other objects and advantages of the present invention will be apparent from the accompanying description when considered in conjunction with the following drawings, in which:

FIG. 1 is a longitudinal, sectional view of the silencer according to the present invention schematically showing the silencer's structure in the first variation.

FIGS. 2 and 3 are cross-sectional views of the silencer of FIG. 1 taken along lines 1—1 and 2—2 respectively.

Figure 6:
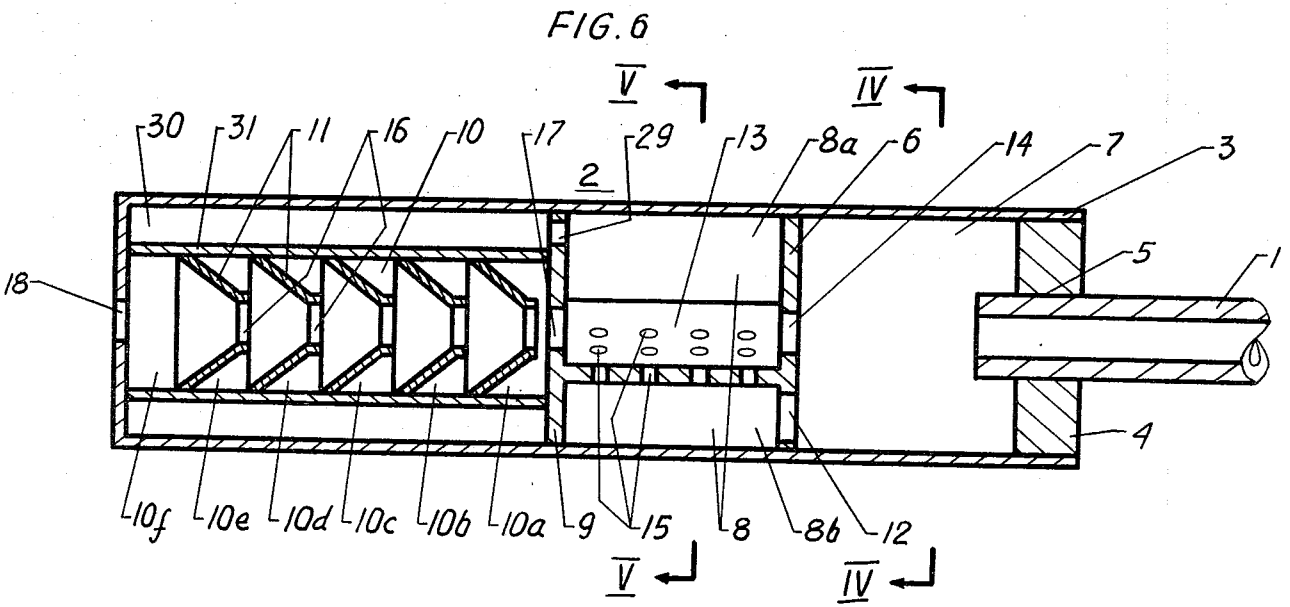
FIG. 6 is a longitudinal sectional view of the silencer according to the present invention schematically showing the silencer's structure in the third variation.
Figure 7:
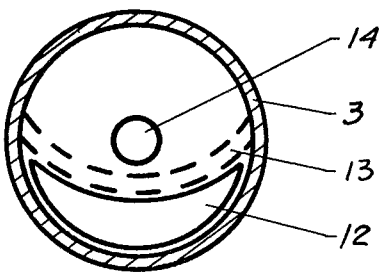
Figure 8:
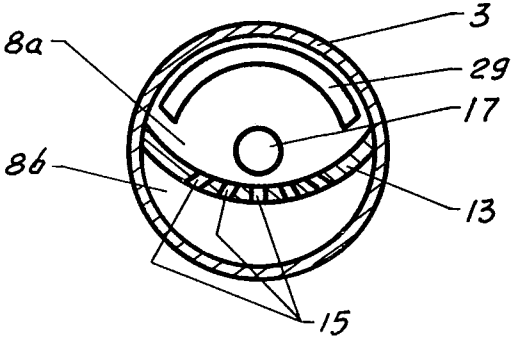

FIGS. 7 and 8 are cross-sectional views of the silencer of FIG. 6 taken along the lines 4—4 and 5—5 respectively.

Figure 9:
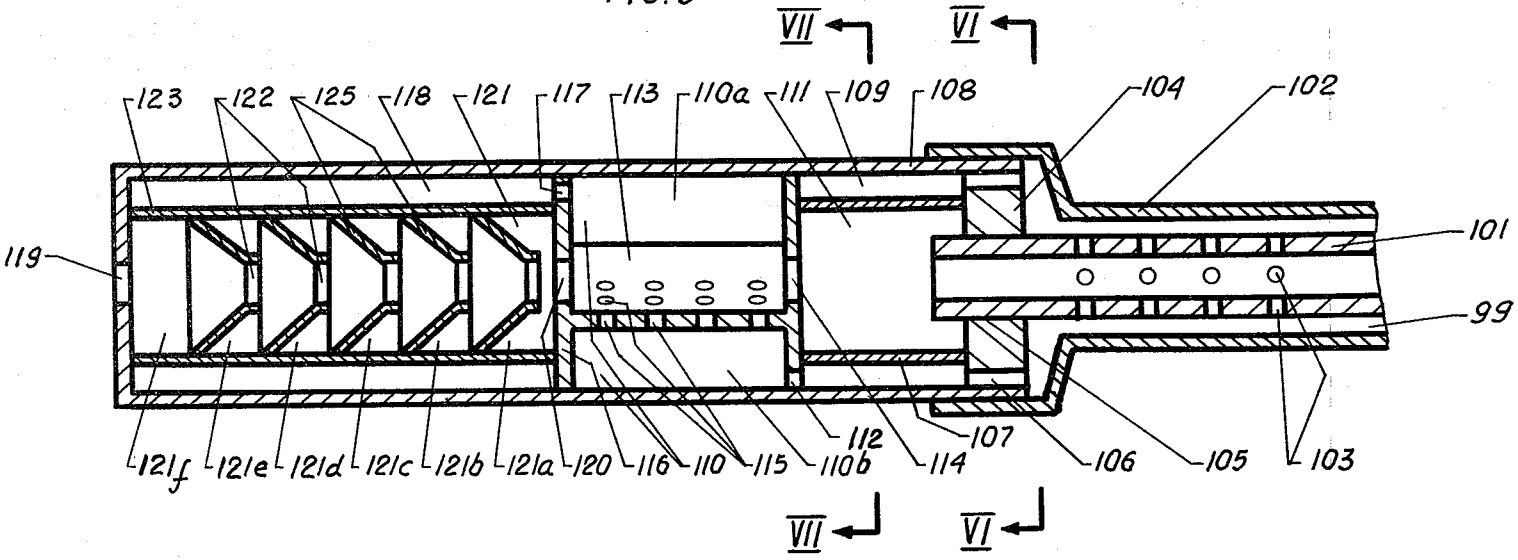

FIG. 9 is a longitudinal, sectional view of the silencer according to the present invention showing schematically the silencer's structure in the fourth variation.

Figure 10:
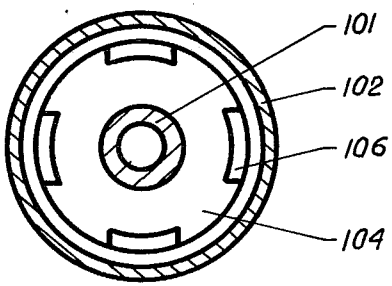
Figure 11:
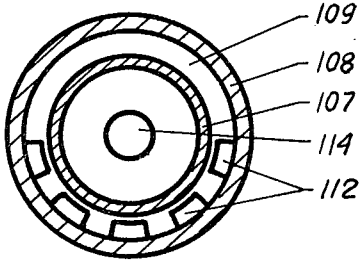

FIGS. 10 and 11 are cross-sectional views of silencer in FIG. 9 taken along lines 6—6 and 7—7, respectively.

Figure 12:
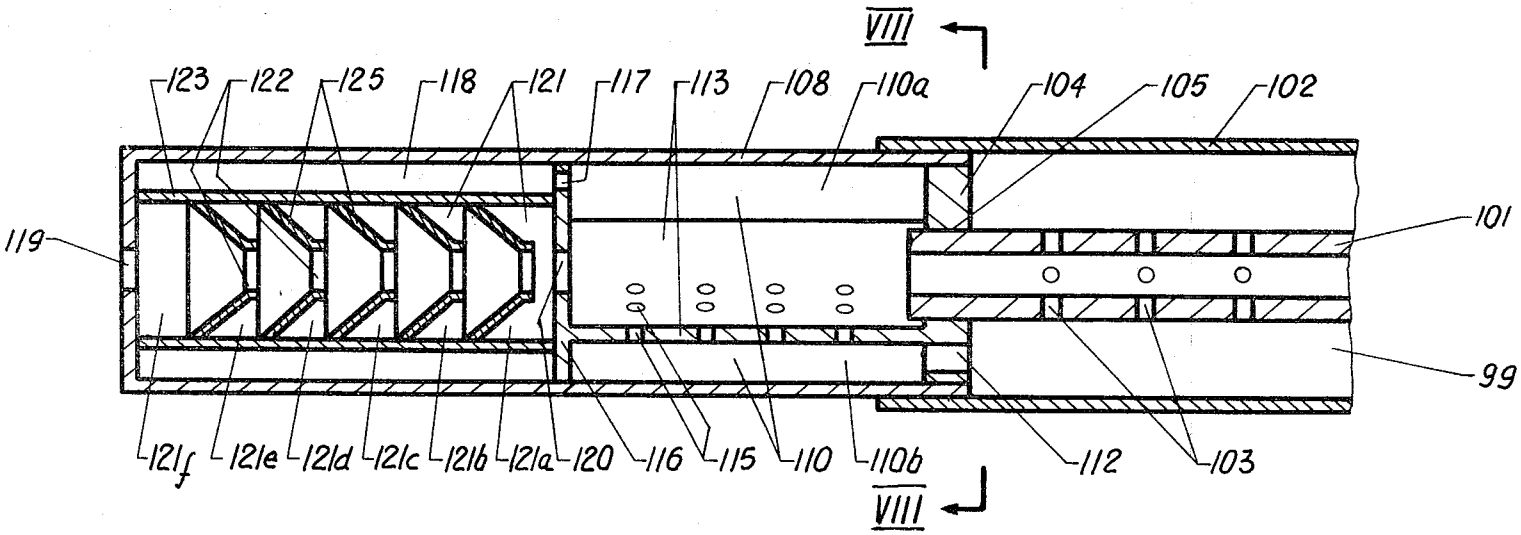

FIG. 12 is a longitudinal, sectional view of the silencer according to the present invention showing schematically the silencer's structure in the fifth variation.

Figure 13:
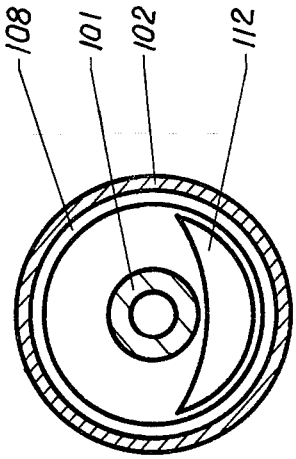

FIG. 13 is a cross-sectional view of the silencer in FIG. 12 taken along line 8—8.

Figure 14:
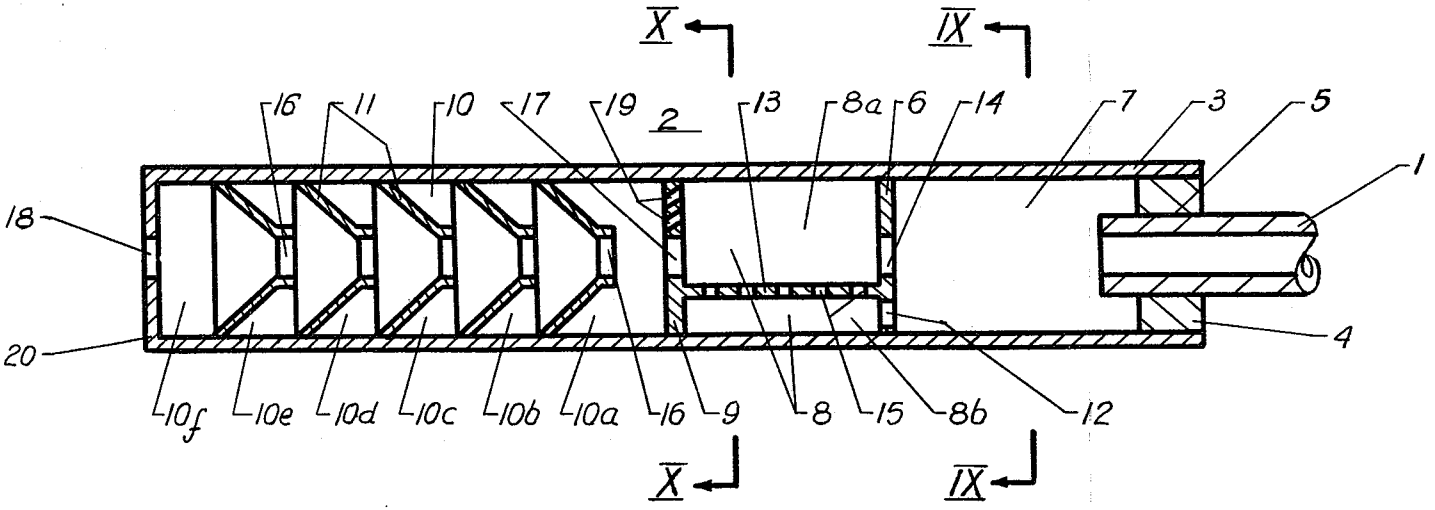

FIG. 14 is a longitudinal, sectional view of the silencer according to the present invention schematically showing the silencer's structure in the sixth variation.

Figure 15:
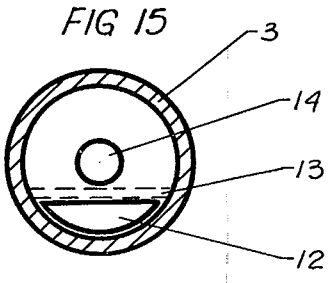
Figure 16:
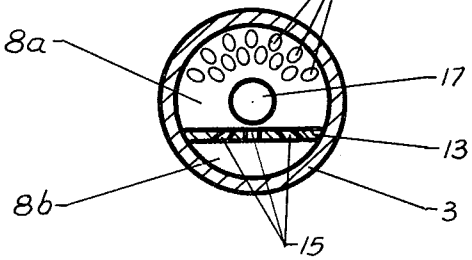

FIGS. 15 and 16 are cross-sectional views of the silencer of FIG. 14 taken along lines 9—9 and 10—10 respectively.

Figure 17:
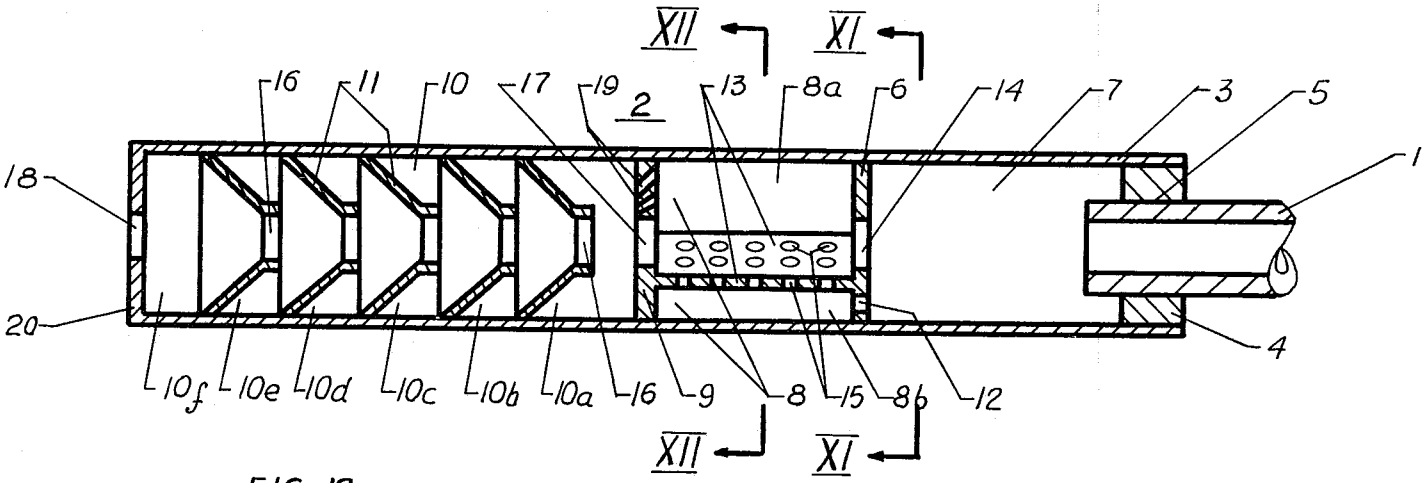

FIG. 17 is a longitudinal, sectional view of the silencer according to the present invention schematically showing the silencer's structure in the seventh variation.

Figure 18:
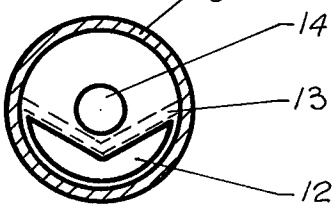
Figure 19:
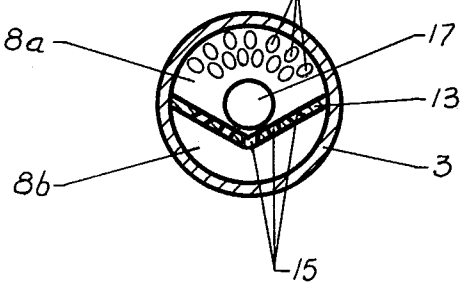

FIGS. 18 and 19 are cross-sectional views of the silencer of FIG. 17 taken along lines 11—11 and 12—12 respectively.

Figure 1:
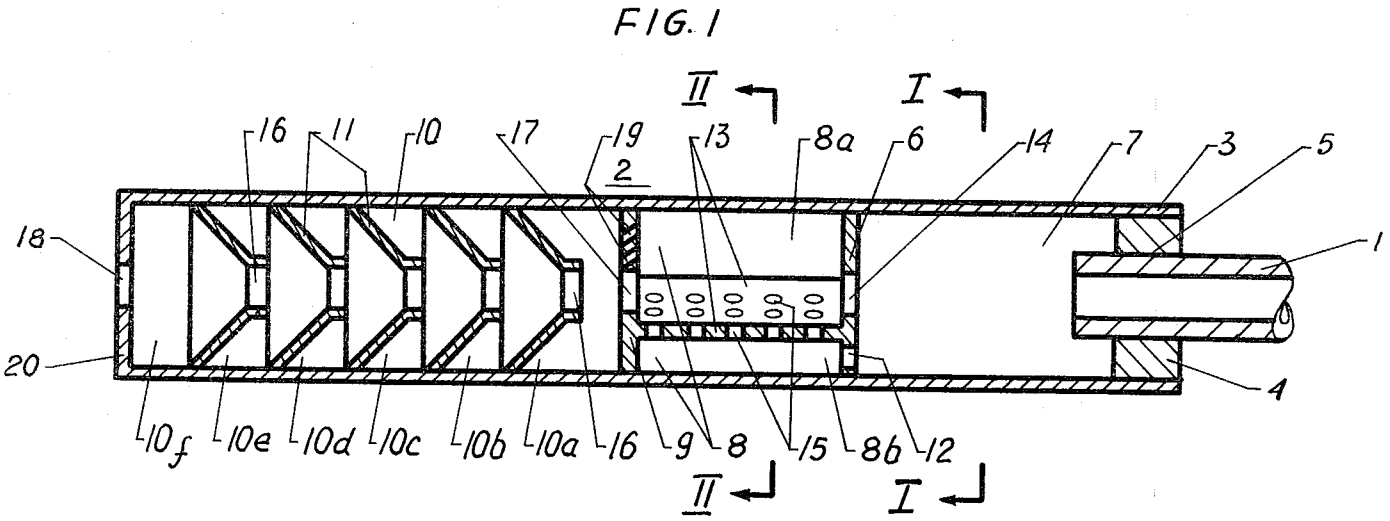
Figure 2:
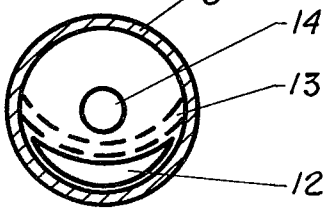
Figure 3:
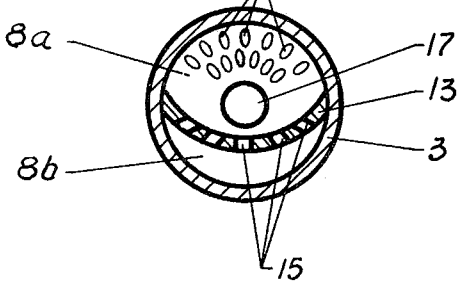

FIG. 1 shows the first modification of silencer 2 attached to the end of barrel 1 of the firearm. Silencer 2 comprises a tubular casing 3 having a rear wall 4 with an aperture 5 therein, which is adapted for mounting upon the end of barrel 1 of the firearm. Within casing 3 is partition 6, which together with rear wall 4, forms a first chamber 7. On the other side of the partition 6 is a second chamber 8 which is further limited by an additional partition 9. On the other side of partition 9 is the third chamber 10. The second chamber 8 is divided by trough shaped partition 13 into two sub-chambers- 8*a* and 8*b*. The partition 6, which is between the first and second chambers, has two openings—12 and 14. The opening 14 is for a passage of the projectile and the discharged gases (which form the main stream of the discharged gases passing through the opening 14) from the first chamber 7 to the sub-chamber 8*a*. Opening 12 is only for the passage of discharged gases from the first chamber 7 to the sub-chamber 8*b*. Partition 13 has a lot of holes 15. The axes of these holes 15 cross with the axis of the silencer or in the same way with the axis of the main stream of the discharged gases. Therefore, the discharged gases in sub-chamber 8*b* are divided by partition 13 into a lot of streams and then hit the main stream of the discharged gases, which is in sub-chamber 8*a*. Thus, the dispersion of the discharged gases and decrease of their energy take place. Partition 9, which is between the second and the third chambers has numerous openings 19 and the single opening 17. Opening 17 is for the passage of the projectile and for the passage of the main stream of the discharged gases from the second chamber 8 to the third chamber 10. The axis of opening 17 is the axis of the silencer 2. The axes of the openings 19 cross with the axis of the main stream of discharged gases passing through the opening 17. Therefore partition 9 by means of openings 19 creates a lot of auxiliary streams of the discharged gases, which repeatedly strike the main stream of discharged gases. And again dispersion of the discharged gases and decrease of their energy takes place. The third chamber 10 is divided by a number of conical partitions 11 into sub-chambers 10*a*,10*b*,10*c*,10*d*,10*e* and 10*f*. The apices of the conical partitions 11 are directed toward the muzzle end of the silencer. Every partition 11 has a hole 16 for the passage of the projectile and the discharged gases. The third chamber 10 is closed at the front end by wall 20 in which there is an opening 18 for the exit of the projectile and the discharged gases into the atmosphere.

Figure 4:
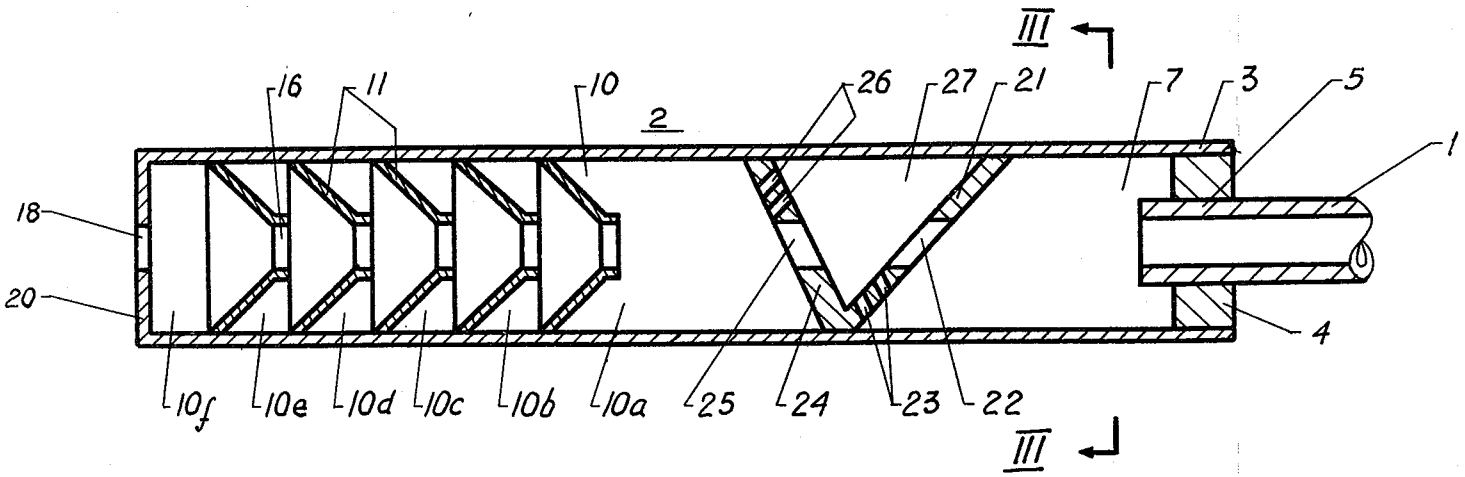
FIG. 4 is a longitudinal sectional view of the silencer according to the present invention schematically showing the silencer's structure in the second variation.
Figure 5:
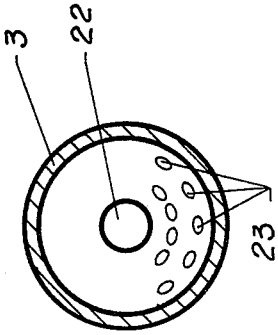
FIG. 5 is a cross-sectional view of the silencer of FIG. 4 taken along the line 3—3.

FIG. 4 shows the second variation of silencer 2 attached to the end of barrel 1 of a firearm. Silencer 2 comprises a tubular casing 3 having a rear wall 4 with an aperture 5 therein, which is adapted for mounting upon the end of barrel 1 of the firearm. Within casing 3 is partition 21, which together with a rear wall 4 forms a first chamber 7. Partition 21 is inclined backwards with respect to the axis of the silencer. On the other side of partition 21 is a second chamber 27 which is further limited by an additional partition 24. The partition 24 is inclined forward with respect to the axis of the silencer 2. On the other side of partition 24 is a third chamber 10. The partition 21, which is between the first and the second chambers, has a multitude of openings 23 and the single opening 22. Opening 22 is for the passage of the projectile and for the passage of the main stream of the discharged gases from the first chamber 7 to the second chamber 27. The axis of opening 22 is the axis of the silencer 2. The axes of the openings 23 cross with the axis of the main stream of discharged gases passing through opening 22. Therefore partition 21 by means of openings 23 makes a lot of auxiliary streams of the discharged gases which strike the main stream of discharged gases passing through opening 22. Thus, the dispersion of the discharged gases and the decrease of their energy takes place. The partition 24 which there is between the second and the third chambers has numerous openings 26 and the single opening 25. Opening 25 is for the passage of the projectile and for the passage of the main stream of the discharged gases from the second chamber 27 to the third chamber 10. The axis of the opening 25 is the axis of the silencer 2. The axes of openings 26 cross with the axis of the main stream of the discharged gases passing through opening 25. Therefore, partition 24 by means of openings 26 produces a lot of auxiliary streams of discharged gases, which repeatedly strike the main stream of discharged gases. And again the dispersion of the discharged gases and decrease of their energy take place. The third chamber 10 in FIG. 4 is the same as chamber 10 in FIG. 1.

FIG. 6 shows the third variation of silencer 2 attached to the end of barrel 1 of the firearm. Also, as in the FIG. 1, silencer 2 comprises a tubular casing 3 having a rear wall 4 with an aperture 5 therein, which is adapted for mounting upon the end of barrel 1 of the firearm. Also as in the FIG. 1 within casing 3 is partition 6, which together with rear wall 4, forms a first chamber 7. Also, as in the FIG. 1, on the other side of partition 6 is a second chamber 8 which is further limited by an additional partition 9. On the other side of the partition 9 there are the third chamber 10 and the fourth chamber 30. Also as in the FIG. 1 the second chamber 8 is divided by trough shaped partition 13 into two sub-chambers, 8*a* and 8*b*. Also as in the FIG. 1 partition 6, which is between the first and second chambers, has two openings 12 and 14. The opening 14 is for passage of the projectile and the main stream of discharged gases from the first chamber 7 to the sub-chamber 8*a*. The opening 12 is only for passage of the discharged gases from the first chamber 7 to sub-chamber 8*b*. Also as in the FIG. 1, partition 13 has a lot of holes 15. The axes of these holes 15 cross with the axis of the silencer (or with the axis of the main stream of the discharged gases). Therefore, the discharged gases in the sub-chamber 8*b* are divided by the partition 13 into a lot of auxiliary streams and then strike the main stream of the discharged gases, which are located in sub-chamber 8*a*. Thus, dispersion of the discharged gases and the decrease of their energy takes place. The partition 9 which is between the second chamber 8 and the third chamber 10 and the fourth chamber 30 has two openings, namely, opening 17 and opening 29. Opening 17 is for passage of the projectile from the second chamber 8 to the third chamber 10, and this opening is also the sole passage for the discharged gases from the second chamber 8 to the third chamber 10 of the silencer 2. Opening 29 is firstly for passage of the discharged gases from the second chamber 8 to the fourth chamber 30 and then for passage of the same discharged gases back from the fourth chamber 30 to the second chamber 8. Between the third chamber 10 and the fourth chamber 30 there is the cylindrical partition 31. The third chamber 10 in the FIG. 6 is the same as chamber 10 in FIGS. 1 and 4.

FIG. 9 shows the fourth variation of the silencer which is a component part of a firearm.

When a firearm is discharged, all the discharged gases push the projectile from barrel 101 of the weapon. When the projectile has passed holes 103 situated in the barrel of the firearm a part of discharged gases continues to push the projectile from barrel 101 of the firearm, while another part of the discharged gases rushes to chamber 99 through holes 103. From chamber 99 this latter part of the discharged gases rushes through apertures 106 into chamber 109, and then these discharged gases rush through apertures 112 into sub-chamber 110*b*. At the same time, the first part of the discharged gases following after a projectile rushes into chamber 111 and fills it. Then this first part of the discharged gases goes from chamber 111 through opening 114 to sub-chamber 110*a*. Opening 114 is at the same time for passage of the projectile and for passage of the first part of the discharged gases from chamber 111 to sub-chamber 110*a*. One should note that chamber 110 is divided by trough shaped partition 113 into two sub-chambers - 110*a* and 110*b*.

The discharged gases, passing from the chamber 111 into the sub-chamber 110*a*, form the main stream of the discharged gases. The axis of the main stream of the discharged gases is at the same time the axis of the silencer. At the same time the second part of the discharged gases, which is in sub-chamber 110*b* and has more energy than the first part of the discharged gases in the sub-chamber 110*a*, rushes through a lot of holes 115 to sub-chamber 110*a*. These holes 115 form a lot of auxiliary streams of discharged gases.

FIG. 14 shows the sixth variation of the silencer 2 attached to the end of barrel 1 of the firearm. The silencer in FIG. 14 differs from the silencer in FIG. 1 only in that partition 13 in this sixth variation has plane shape instead of shape of trough in first variation (FIG. 1). In all the rest the silencers in FIG. 14 and in FIG. 1 are completely indentical.

FIG. 17 shows the seventh variation of the silencer 2 attached to the end of barrel 1 of the firearm. The silencer in FIG. 17 differs from the silencers in FIG. 1 and FIG. 14 only in that partition 13 in this seventh variation has the shape of the surface comprising two planes instead of shape of trough in first variation (FIG. 1) or plane shape in sixth variation (FIG. 14). In all the rest the silencers in FIG. 17, FIG. 1 and FIG. 14 are completely indentical. The axes of these auxiliary streams of the discharged gases cross with the axis of the main stream of the discharged gases in sub-chamber 110*a*. Therefore, these auxiliary streams of discharged gases strike with great energy the main stream of the discharged gases. Thus a very effective dispersion of the discharged gases and decrease of their energy take place.

The partition 116, which is between chambers 110, 118 and 121, has two openings, namely, opening 117 and opening 120. Opening 120 is for passage of the projectile from chamber 110 to chamber 121, and this opening 120 is also the sole passage for the disgarged gases from chamber 110 to chamber 121 of the silencer. Opening 117 is firstly for passage of the discharged gases from chamber 110 to chamber 118 and then for passage of the same discharged gases back from chamber 118 to chamber 110. Between the chamber 118 and the chamber 121 there is the cylindrical partition 123. Chamber 121 in FIG. 9 is the same one as chamber 10 in FIGS. 1, 4 and 6

FIG. 12 shows the fifth variation of the silencer which is a component part of a firearm.

The silencer in FIG. 12 differs from the silencer in FIG. 9 only in that chamber 111 in FIG. 12 is missing and chamber 110 accomplishes two functions simultaneously (at the same time) i.e. in it the expansion of discharged gases and mixing the main stream of discharged gases with the auxiliary streams of discharged gases take place. In the main, the silencer of the fifth variation works the same way as the silencer of the fourth variation.

Thus it can be seen that the silencer according to the present invention is a very effective unit for automatic and ordinary weapons. It is simple in construction and can be readily fabricated by ordinary manufacturing processes.

Although but a few variations of the present invention have been illustrated and described, it will be apparent to those skilled in the art that various changes and modifications may be made therein without departing from the spirit of the invention or from the scope of the appended claims.

What is claimed is:

1. A silencer for mounting on the barrel of a hand weapon comprising:

a casing having its rear part in communication with the barrel of the hand weapon, said casing having an apertured front end wall with said aperture therein for the exit of the projectile and discharged gases, at least three chambers axially aligned in said casing, the first chamber of said chambers following the barrel of the hand weapon for expanding of the discharged gases, the second chamber of said chambers being to decrease discharged gases energy and movement and being separated from the first and the third chambers by partitions having openings for the passage of the projectile and for forming the main stream of discharged gases following the projectile, at least one additional trough shaped partition inside of said second chamber said trough shaped partition extending across the interior circumference of said casing and said trough shaped partition having openings therein, said trough shaped partition dividing said second chamber into sub-chambers at least one of which is for forming auxiliary streams of discharged gases and guiding said auxiliary streams of discharged gases through said openings into the main stream of discharged gases, said openings in said trough shaped partition inside of said second chamber having axes directed to said main stream of discharged gases, the third chamber of said chambers comprising additional partitions for dispersing sound waves and supplementary decreasing the discharged gases energy and movement.

2. A silencer as claimed in claim 1 in which at least one of said partitions separating said second chamber from said first and third chambers has additional openings for forming auxiliary streams of discharged gases and guiding said auxiliary streams of discharged gases to said main stream of discharged gases for dispersion of said main stream of discharged gases and great decrease in the energy and movement of the discharged gases, the said additional openings with their axes directed to said main stream of discharged gases.

3. A silencer for mounting on the barrel of a hand weapon comprising:

a casing having its rear part in communication with the barrel of the hand weapon, said casing having an apertured front end wall with said aperture therein for the exit of the projectile and discharged gases, at least three chambers axially aligned in said casing, the first chamber of said chambers following the barrel of the hand weapon for expanding of the discharged gases, the second chamber of said chambers being to decrease discharged gases energy and movement and being separated from the first and the third chambers by partitions having openings for the passage of the projectile and for forming the main stream of discharged gases following the projectile, at least one additional plane shaped partition inside of said second chamber said plane shaped partition extending across the interior circumference of said casing and said plane shaped partition having openings therein, said plane shaped partition dividing said second chamber into sub-chambers at least one of which is for forming auxiliary streams of discharged gases and guiding said auxiliary streams of discharged gases through said openings into the main stream of discharged gases, said openings in said plane shaped partition inside of said second chamber having axes directed to said main stream of discharged gases, the third chamber of said chambers comprising additional partitions for dispersing sound waves and supplementary decreasing the discharged gases energy and movement.

4. A silencer as claimed in claim 3 in which at least one of said partitions separating said second chamber from said first and third chambers has additional openings for forming auxiliary streams of discharged gases and guiding said auxiliary streams of discharged gases to said main stream of discharged gases for dispersion of said main stream of discharged gases and great decrease in the energy and movement of the discharged gases, the said additional openings with their axes directed to said main stream of discharged gases.

5. A silencer for mounting on the barrel of a hand weapon comprising:

a casing having its rear part in communication with the barrel of the hand weapon, said casing having an apertured front end wall with said aperture therein for the exit of the projectile and discharged gases, at least three chambers axially aligned in said casing, the first chamber of said chambers following the barrel of the hand weapon for expanding of the discharged gases, the second chamber of said chambers being to decrease discharged gases energy and movement and being separated from the first and the third chambers by partitions having openings for the passage of the projectile and for forming the main stream of discharged gases following the projectile, at least one additional partition having the shape of the surface comprising at least two intersecting planes inside of said second chamber said partition having the shape of the surface comprising at least two intersecting planes extending across the interior circumference of said casing and said partition having the shape of the surface comprising at least two intersecting planes having openings therein, said partition having the shape of the surface comprising at least two intersecting planes dividing said second chamber into sub-chambers at least one of which is for forming auxiliary streams of discharged gases and guiding said auxiliary streams of discharged gases through said openings into the main stream of discharged gases, said openings in said partition having the shape of the surface comprising at least two intersecting planes inside of said second chamber having axes directed to said main stream of discharged gases, the third chamber of said chambers comprising additional partitions for dispersing sound waves and supplementary decreasing the discharged gases energy and movement.

6. A silencer as claimed in claim 5 in which at least one of said partitions separating said second chamber from said first and third chambers has additional openings for forming auxiliary streams of discharged gases and guiding said auxiliary streams of discharged gases to said main stream of discharged gases for dispersion of said main stream of discharged gases and great decrease in the energy and movement of the discharged gases, the said additional openings with their axes directed to said main stream of discharged gases.

7. A silencer for mounting on the barrel of a hand weapon comprising:

a casing having its rear part in communication with the barrel of the hand weapon, said casing having an apertured front end wall with said aperture therein for the exit of the projectile and discharged gases, at least three chambers axially aligned in said casing, the first chamber of said chambers following the barrel of the hand weapon for expanding of the discharged gases, the second chamber of said chambers being to decrease discharged gases energy and movement and being formed of at least one V-shaped element having openings for the passage of the projectile and forming the main stream of discharged gases following the projectile, said V-shaped element having also additional openings for forming auxiliary streams of discharged gases and guiding said auxiliary streams of discharged gases to said main stream of discharged gases for dispersion of said main stream of discharged gases and great decrease in the energy and movement of the discharged gases, said additional openings in said V-shaped element having axes directed to said main stream of discharged gases, the third chamber of said chambers comprising partitions for dispersing sound waves and supplementary decreasing the discharged gases energy and movement.

* * * * *